US008641178B1

(12) United States Patent
Snyder et al.

(10) Patent No.: US 8,641,178 B1
(45) Date of Patent: Feb. 4, 2014

(54) INK RECEPTACLE FOR COLLECTING AND CONTROLLABLY RELEASING PURGED INK

(71) Applicant: Xerox Corporation, Norwalk, CT (US)

(72) Inventors: Trevor J. Snyder, Newberg, OR (US); Isaac S. Frazier, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/668,761

(22) Filed: Nov. 5, 2012

(51) Int. Cl.
*B41J 2/175* (2006.01)

(52) U.S. Cl.
USPC ..... 347/85; 347/36; 347/90; 65/27; 198/711

(58) Field of Classification Search
None
See application file for complete search history.

(56) References Cited

U.S. PATENT DOCUMENTS

| | | | | |
|---|---|---|---|---|
| 4,796,748 | A * | 1/1989 | Manning | 198/711 |
| 4,940,478 | A * | 7/1990 | Naber et al. | 65/27 |
| 4,948,477 | A * | 8/1990 | Gibson et al. | 205/629 |
| 7,901,033 | B2 | 3/2011 | Nishida | |
| 8,136,934 | B2 | 3/2012 | Snyder et al. | |
| 8,147,049 | B2 | 4/2012 | Korol et al. | |
| 2001/0002682 | A1 * | 6/2001 | Boese | 241/79 |
| 2005/0285917 | A1 * | 12/2005 | Nichols et al. | 347/90 |
| 2010/0123764 | A1 | 5/2010 | Slotto et al. | |

* cited by examiner

*Primary Examiner* — Matthew Luu
*Assistant Examiner* — John P Zimmermann
(74) *Attorney, Agent, or Firm* — Maginot, Moore & Beck, LLP

(57) ABSTRACT

An ink recirculation system has been developed to enable controlled release of ink collected in an ink receptacle into a printhead. The ink receptacle includes an indentation in a substantially planar surface and is configured to receive ink in the indentation from a printhead. The indentation has a shape that enables the ink receptacle to release ink at varying rates as a pivot angle of the ink receptacle is varied by a positioning system. The shape of the indentation enables the receptacle to dose ink into an ink reservoir in the printhead at known rates to control the amount of ink recycled to the printhead.

20 Claims, 5 Drawing Sheets

INK RECEPTACLE FOR COLLECTING AND CONTROLLABLY RELEASING PURGED INK

TECHNICAL FIELD

This disclosure relates generally to systems that supply and recover fluid from a device, and more particularly, to an inkjet printer configured to recover liquid ink from an inkjet printhead.

BACKGROUND

In general, inkjet printing machines or printers include at least one printhead that ejects drops or jets of liquid ink onto a recording or image forming media. A phase-change inkjet printer employs phase change inks that are solid at ambient temperature, but transition to a liquid phase at an elevated temperature. The melted ink can then be ejected by a printhead to form an ink image on an image receiving member. The ink image may be formed on a layer of release agent coating an intermediate imaging member, such as a rotating drum or belt, and then transferred to an image receiving substrate, such as a sheet of paper, as the substrate passes through a nip formed between a transfix roller and the intermediate imaging member. In other printing systems, the ink can be ejected directly onto printing media directed past the printheads.

Phase change ink printers often include one or more heaters that generate heat to maintain a supply of phase change ink in a liquid state in the printheads and inkjets for use during printing operations. Typically, the heaters are electrical heaters that consume electrical energy to generate the desired amount of heat. In order to reduce energy usage, phase change ink printers deactivate various components, including heaters, in the printer during a sleep mode to conserve energy. The ink held in the printheads and inkjets cools and solidifies when the heaters are deactivated.

While sleep modes enable a printer to operate with reduced electrical energy consumption, the solidification of phase change ink within the printer presents difficulties in printing high quality documents when the printer emerges from sleep mode. As phase change ink within an inkjet printing apparatus cools and solidifies, the ink contracts, allowing air into the pressure chambers and fluid conduits within the printheads. As the solidified ink heats and liquefies during a subsequent warm-up process, the air forms bubbles in the liquefied ink that can interfere with operation of the inkjets in the printhead. Additionally, during the warm-up process, both the ink and air bubbles expand due to the heat applied to the printheads. The expanding air bubbles may force some ink through the ejector nozzles, which is referred to as "drooling." The drooled ink can contaminate other nozzles in the printheads or separate from the printheads and produce errant marks on the image receiving member.

To eliminate air bubbles in the liquefied ink within the printheads and to clear contaminants from the inkjet nozzles and external face of each printhead, the inkjet printing apparatus undergoes a "purge" operation, during which pressure applied to the reservoirs and passageways within the printheads urges the liquid ink and the air bubbles through the nozzles of the inkjets. In a purge operation, the inkjets emit a stream of ink that flows down the face of the printhead and is collected in a waste ink receptacle. The purge operation removes air bubbles from the inkjets in the printheads and other fluid conduits in the inkjet printing apparatus.

In some printing apparatus designs, a wiping operation occurs after the purge operation. In a wiping operation, a wiper blade engages the face of a printhead and moves across the printhead face. The wiper blade cleans residual ink and contaminants that remain on the face of the printhead after the purge operation. In existing printers, the purged ink and ink from a wiping operation is typically collected in a waste reservoir and is eventually discarded. In some instances, small amounts of purged ink dripping into the waste reservoir results in the ink solidifying immediately after landing in the waste reservoir. Over multiple purge operations, the ink solidifies to form tall narrow ink structures, known as stalagmites, rather than spreading out and filling the entire volume of the waste reservoir, reducing the ink capacity of the waste reservoir. In printers that enter sleep modes more often to reduce electrical energy consumption, the number of purge cycles and the corresponding amount of ink collected in the waste reservoir increases. Thus, improvements to phase change ink printers that reduce the amount of ink discarded from the printer and improve the collection of waste ink are desirable.

SUMMARY

In one embodiment a printing apparatus enables controlled release of ink into a printhead reservoir and delivers a greater quantity of ink into a collecting tray. The printing apparatus includes an ink receptacle and a positioning system. The ink receptacle has a substantially planar member with an indentation formed in the substantially planar member to retain a volume of ink. The indentation is configured to have a cross-sectional area that enables ink to be released at a rate that varies with an angle at which the substantially planar member pivots. The positioning system is operatively connected to the substantially planar member to move the ink receptacle from a first position where the indentation receives ink from a printhead to a second position where the indentation releases ink into an ink reservoir at a rate that corresponds to the pivot angle of the substantially planar member.

In another embodiment, a printer enables controlled release of ink into a printhead reservoir and delivers a greater quantity of ink into a collecting tray. The printer comprises a printhead, an ink receptacle, and a positioning system. The printhead includes a faceplate having a plurality of inkjet ejectors and an ink reservoir fluidly connected to the faceplate and configured to supply ink to the plurality of inkjet ejectors. The ink receptacle includes a substantially planar member and an indentation formed in the substantially planar member to retain a volume of ink. The indentation is further configured with a cross-sectional area that enables ink to be released at a rate that varies with an angle at which the substantially planar member pivots. The positioning system is operatively connected to the substantially planar member to move the ink receptacle from a first position where the indentation receives ink from the printhead to a second position where the indentation releases ink into the ink reservoir at a rate that corresponds to the pivot angle of the substantially planar member.

DETAILED DESCRIPTION

Figure 1:
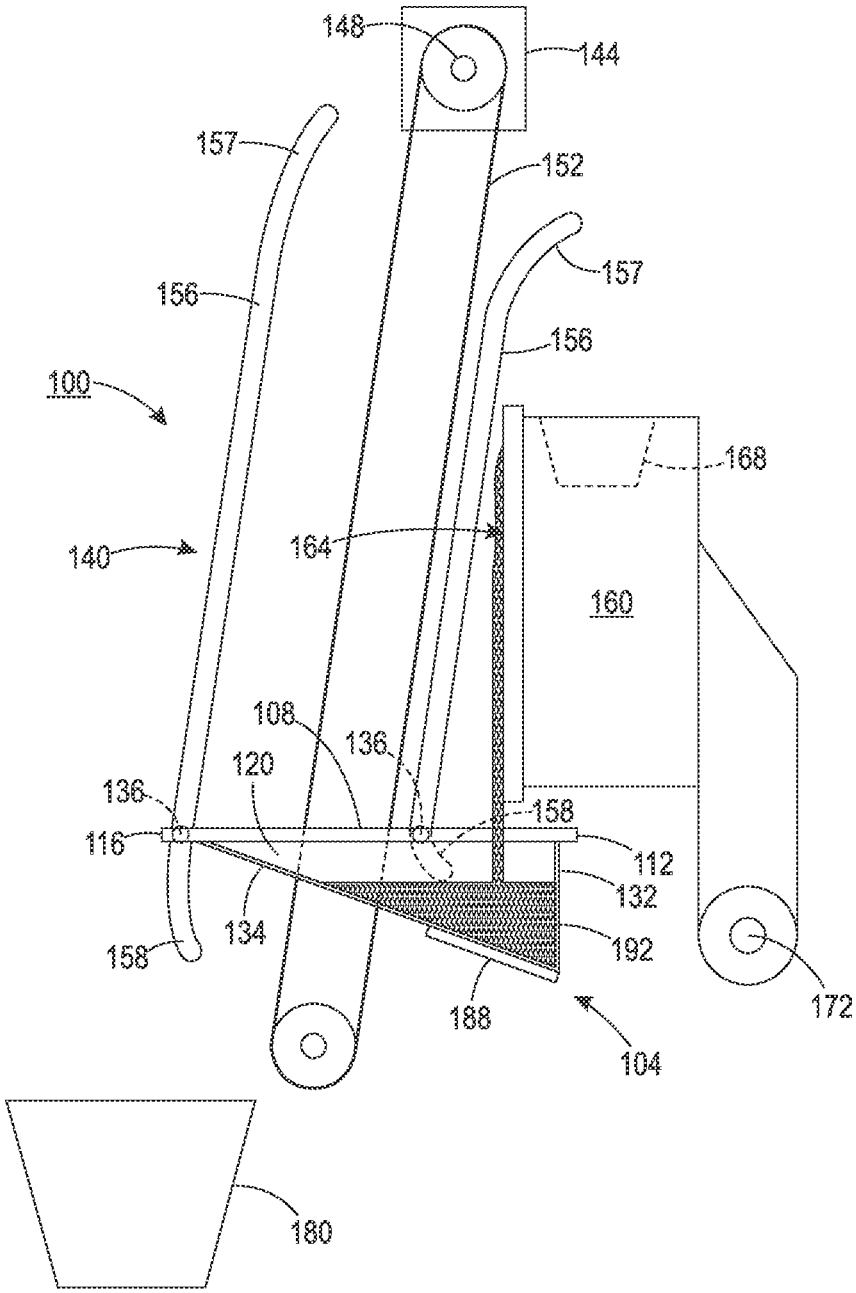
FIG. 1 is a side schematic view of an ink recirculation system receiving ink from a printhead.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and can encompass any such apparatus, such as a digital copier, bookmaking machine, facsimile machine, multi-function machine, or the like, which generates printed images for any purpose. Image data generally include information in electronic form that are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Phase-change ink printers use phase-change ink, also referred to as a solid ink, which is in a solid state at room temperature but melts into a liquid state at a higher operating temperature. The liquid ink drops are printed onto an image receiving surface in either a direct or indirect printer.

The term "printhead" as used herein refers to a component in the printer that is configured with inkjet ejectors to eject ink drops onto an image receiving surface. A typical printhead includes a face having a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

Figure 4:
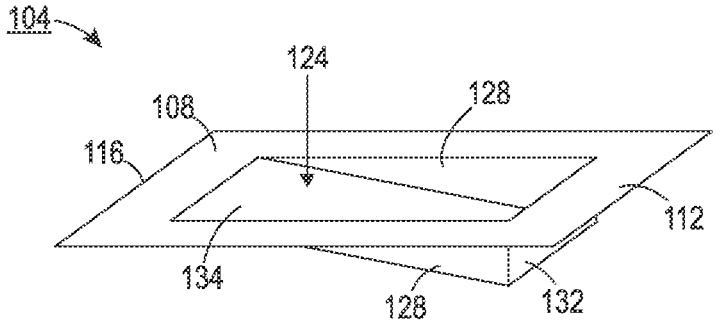
FIG. 4 is a perspective view of a triangular ink receptacle.

FIG. 1 depicts an ink recirculation system 100 for a printer. The ink recirculation system 100 includes a triangular ink receptacle 104, an ink collection tray 180, and a positioning system 140 that is configured to position the triangular ink receptacle 104 with respect to a printhead 160 in the printer. Referring to FIG. 1 and FIG. 4, the triangular ink receptacle 104 has a first end 112 and a second end 116, and includes a substantially planar member 108 in which a triangular indentation 120 has been formed with an opening 124. Two guide followers 136 and a heater 188 are mounted to the receptacle 104. The triangular indentation 120 includes side walls 128, a first end wall 132, and a lower surface 134. These walls define a volume in which ink 192 can be stored. The guide followers 136 are fixedly mounted to the substantially planar member 108. The guide followers 136 are configured to engage guide or cam rails 156 of the positioning system 140 to enable the ink receptacle 104 to move and rotate in a predetermined path defined by the guide rails 156. Thus, the interaction of the guide rails 156 and the guide followers 136 enable the position and orientation of the ink receptacle 104 to be controlled. The heater 188 is operatively connected to the triangular indentation 120 and is operated to generate heat to melt the phase change ink 192 in the ink receptacle 104 to enable the ink to flow from the ink receptacle 104 into the printhead 160 or ink collecting tray 180 as the ink receptacle 104 is pivoted. The side walls 128 of the illustrated embodiment are substantially vertical to reduce spillage of the ink in the ink receptacle 104 in the event the printer in which the ink recirculation system 100 is installed is tilted sideways. In other embodiments the side walls can include a flange extending from the substantially planar surface or the walls can be angled inwardly toward the top of the ink receptacle to further reduce spillage from the sides of the receptacle. In some embodiments, the ink receptacle can be segmented into multiple storage compartments along the cross-process length of the ink receptacle by the addition of additional walls parallel to the side walls. Segmenting the ink receptacle into a plurality of cells serves to further reduce the spillage from the sides of the ink receptacle and to reduce issues that can result from normal manufacturing variation. In addition, segmenting the ink receptacle enables the ink collected in the ink receptacle to be distributed evenly along the cross-process length of the receptacle, rather than accumulating at one end of the receptacle.

Figure 2:
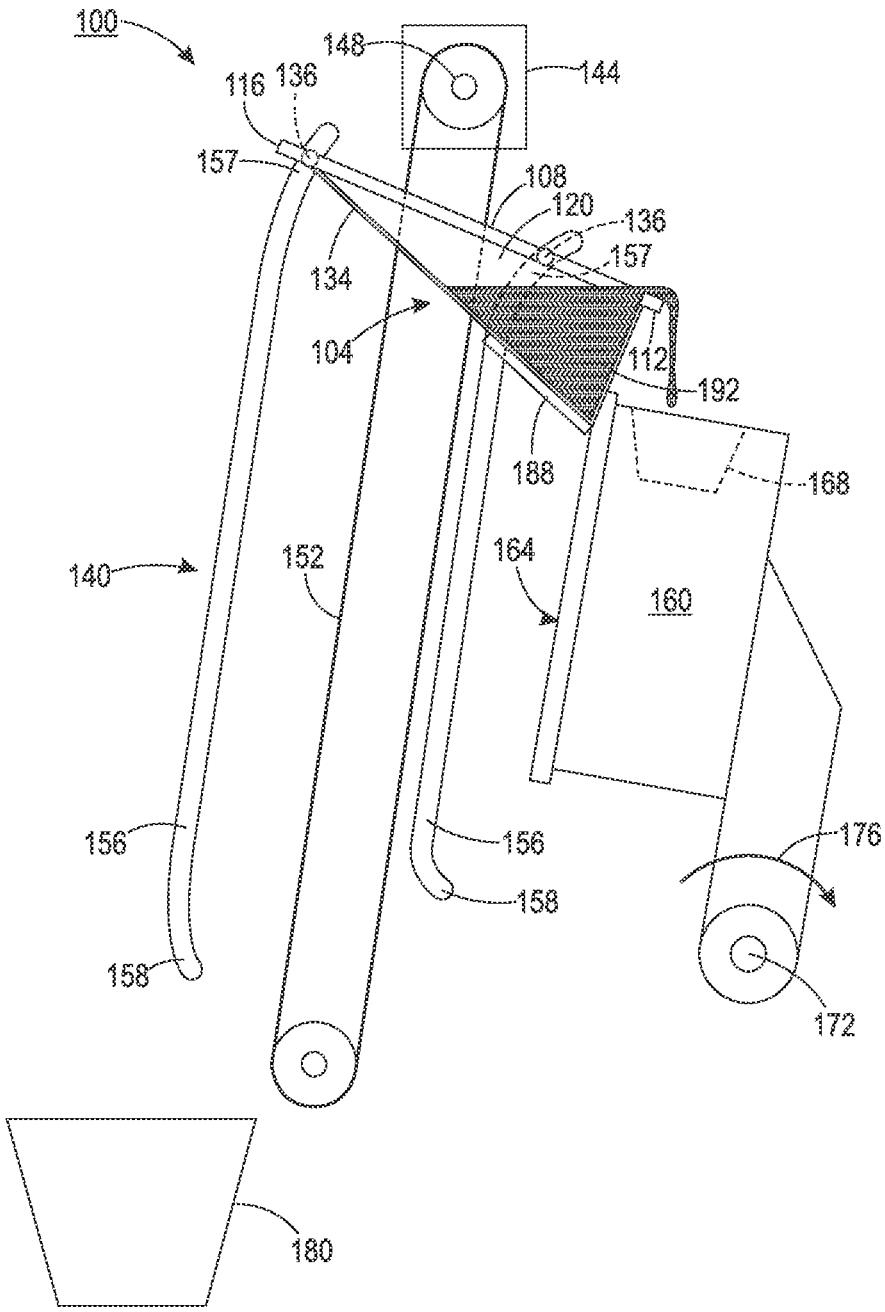
FIG. 2 is a side schematic view of the ink recirculation system of FIG. 1 releasing ink into the printhead.
Figure 3:
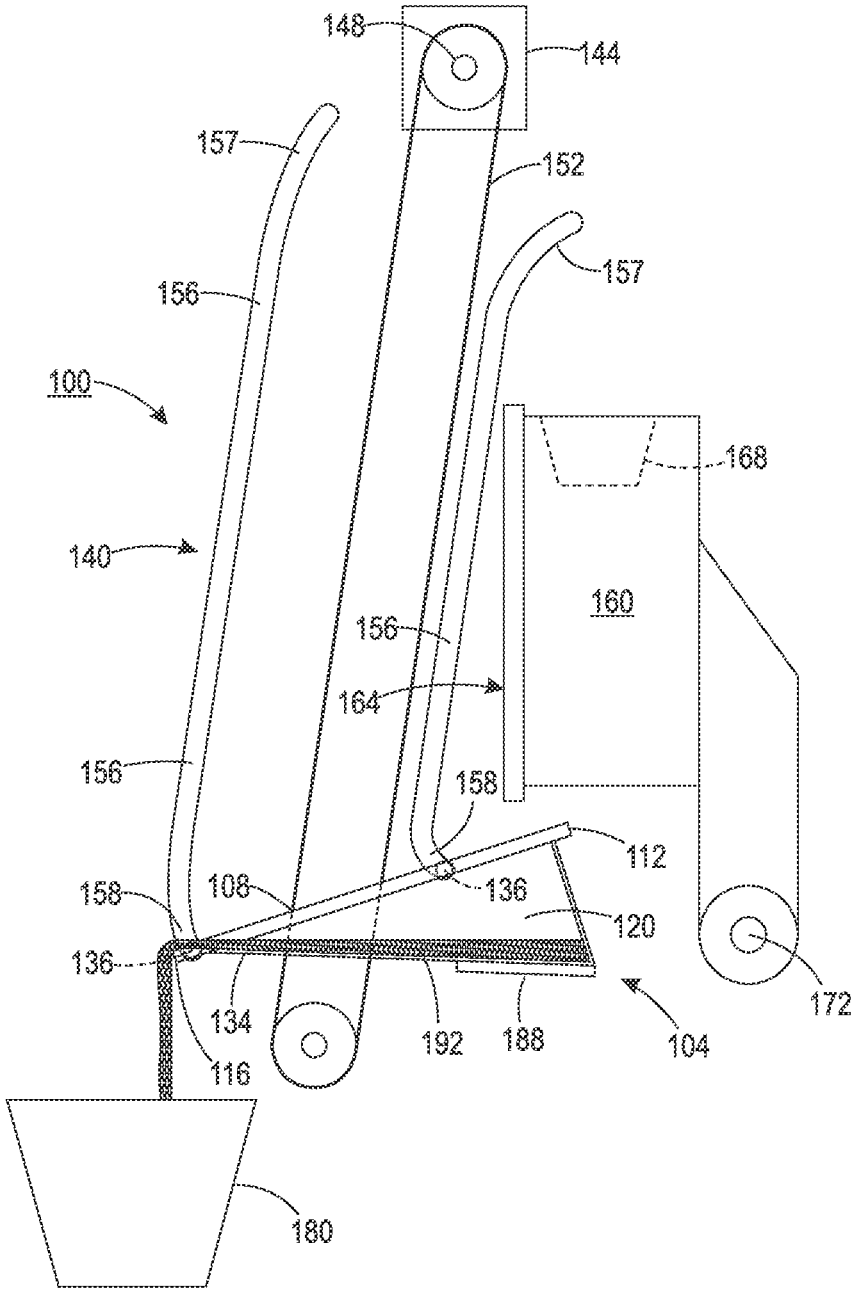
FIG. 3 is a side schematic view of the ink recirculation system of FIG. 1 releasing ink into a collection tray.

The positioning system 140 includes an actuator 144, a drive belt 152, and guide rails 156. The actuator 144 includes an output shaft 148 that is operatively connected to the drive belt 152, and is configured to turn the drive belt 152 in response to the actuator 144 rotating. The drive belt 152 is operatively connected to the ink receptacle 104 and configured to move the triangular ink receptacle 104 as the actuator 144 moves the drive belt 152. The guide followers 136 of the ink receptacle 104 engage the guide rails 156 to enable the movement of the drive belt 152 to move the ink receptacle 104 along a predetermined path formed by the guide rails and to rotate the ink receptacle 104 to predetermined angles along the path to pour ink out of the ink receptacle 104. The guide rails 156 include an upper curved portion 157 and a lower curved portion 158, which pivot the ink receptacle 104 through a plurality of predetermined angles to release ink from the receptacle 104 into the printhead reservoir 168 or the ink collecting tray 180, as described in detail below. Although a belt drive positioning system with guide rails is illustrated in FIG. 1-3, the reader should appreciate that any suitable positioning system can be used to move and pivot the ink receptacle to enable the ink receptacle to collect and release the ink.

In operation, the ink recirculation system 100 is moved below the printhead 160 as the printhead 160 prepares to perform a purge operation. Pressure is applied to an ink reservoir in the printhead 160, resulting in ink 192 flowing from inkjet ejectors in the face 164 of the printhead 160. The ink 192 flows down the printhead face 164 and into the ink receptacle 104 positioned below the printhead 160. In some embodiments the ink receptacle can be positioned adjacent to the printhead face to collect ink from the printhead face by capillary action or the ink can be jetted into the adjacent ink receptacle during a high pressure purge process. In one practical embodiment the ink receptacle is configured to store approximately ten grams of ink, which corresponds to about ten purge cycles. In other embodiments, the ink receptacle can store an amount of ink corresponding to more or fewer purge cycles, depending on the purge frequency, amount of ink purged per cycle, and the like. In some embodiments, the printer in which the ink recirculation system is installed can be configured with a wiper to clean the face of the printhead after the purge cycle is complete. The wiper wipes the printhead face downwardly, urging any ink remaining on the printhead face into the ink receptacle.

The printer is configured to periodically dose the ink back into the printhead reservoir 168 as ink is used for printing and the printhead reservoir is depleted of ink. To recycle the ink 192 into the reservoir 168, the actuator 144 activates to rotate the output shaft 148 and turn the drive belt 152. In response, the ink receptacle 104 moves upwardly as the guide followers 136 move within the guide rails 156. As the actuator moves the ink receptacle 104, the ink in the receptacle is at room temperature, and is therefore in a solid state. Thus, the ink receptacle 104 can be articulated through a wide range of angles without the ink dumping from the reservoir. As shown in FIG. 2, a printhead actuator 172 rotates the printhead 160 about the actuator 172 in direction 176 to move the printhead 160 out of the path of the ink receptacle 104 and enable the receptacle 104 to pass by the printhead 160. The guide followers 136 engage the upper curved portion 157 of the guide rails 156, raising the second end 116 of the ink receptacle 104 above the first end to pivot the ink receptacle. As the actuator continues to move the ink receptacle 104 upwardly, the guide followers 136 in the guide rails 156 pivot the ink receptacle 104 at an increasing angle with reference to the horizontal to enable ink 192 to flow from the first end 112 of the ink receptacle 104 into the ink reservoir 168 in the printhead 160. A controller operating the actuator can thus be configured with instructions stored in a memory that cause the controller, when the instructions are executed, to pivot the ink receptacle 104 at a variety of angles to release a predetermined quantity of ink 192 into the ink reservoir 168 or to release ink 192 at a predetermined rate into the reservoir 168. The triangular shape of the ink receptacle 104, having a steep wall 132 at the first end 112, enables the receptacle 104 to release ink 192 from the first end 112 gradually over a wide range of pivot angles. In systems having multi-color printheads, gradual dosing of the ink into the ink reservoir enables the receptacle to recycle purged ink of multiple colors, for example, cyan, magenta, yellow, and black, which combine to form an ink that is approximately black in color, by pouring the ink from the receptacle into the black ink reservoir without compromising the print quality of the black ink.

In some instances the printer can perform multiple purge operations without ejecting a substantial quantity of ink, and the amount of ink purged can thus exceed an amount that can be dosed back into the black ink reservoir without compromising quality of the black ink. When the ink receptacle 104 fills and cannot dose additional ink 192 into the ink reservoir 168, the positioning system 140 is configured to dump the ink receptacle 104 into the ink collecting tray 180. To perform the ink dump, the actuator 144 activates to move the belt and drop the ink receptacle 104 downwardly, as shown in FIG. 3, where the guide followers 136 of the ink receptacle 104 engage the lower curved portion 158 of the guide rails 156. The lower curved portion 158 lowers the second end 116 of the ink receptacle 104 below the first end 112, pivoting the ink receptacle and releasing ink 192 from the second end 116 of the ink receptacle 104. The triangular shape of the ink receptacle 104 enables the volume of ink in the receptacle 104 to flow from the lower surface 134 into the ink collecting tray 180 at a high flow rate over small pivot angles. Thus, the positioning system 140 need not be configured to pivot the ink receptacle 104 to a large pivot angle to dump the triangular ink receptacle 104 into the tray 180.

In one practical embodiment, the ink receptacle is configured to collect approximately 5-10 grams of ink. In this embodiment, when the ink is heated and released from the ink receptacle into the ink collecting tray, the ink spreads out in the ink collecting tray before solidifying. Consequently, the ink can fill the ink collecting tray uniformly, rather than forming ink stalagmites in the tray, which increases the volume of ink the ink collecting tray can collect before the tray is full and must be manually emptied.

Figure 5:
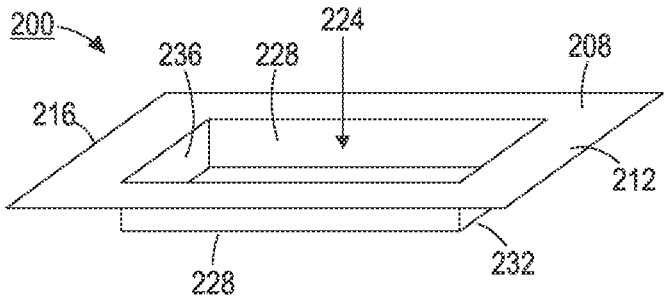
FIG. 5 is a perspective view of a square ink receptacle.

FIG. 5 illustrates an ink receptacle 200 having a square cross-section. The ink receptacle 200 has a first end 212, a second end 216, and a substantially planar member 208 into which an indentation has been formed with two side walls 228, a first end wall 232, and a second end wall 236. The indentation in the substantially planar member 208 has an opening 224. The side walls 228 and the end walls 232 and 236 form a volume in which ink is stored. The ink receptacle 200 can be configured with a positioning system, such as the positioning system 140 of FIG. 1-3, to move the ink receptacle to collect ink from a printhead and release the ink into a reservoir in the printhead or an ink collecting tray. The side walls 228 are substantially vertical to avoid the ink splashing out of the ink receptacle if the printer is tilted sideways. The vertical end walls 232 and 236 release ink at a low rate as the receptacle 200 is pivoted over wide angles, enabling more precise control of the release rate of ink in the receptacle 200.

Figure 6:
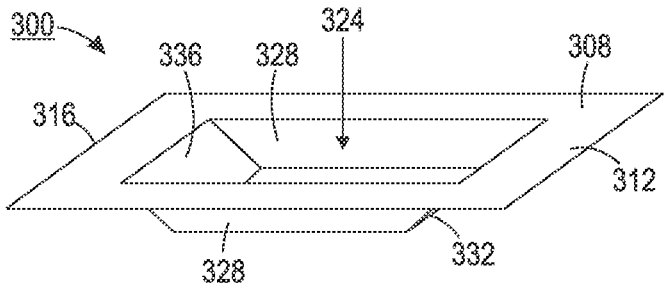
FIG. 6 is a perspective view of a trapezoidal ink receptacle.

FIG. 6 illustrates an ink receptacle 300 having a trapezoidal cross-section. The ink receptacle 300 has a first end 312, a second end 316, and a substantially planar member 308 in which an indentation has been formed with two side walls 328, a first end wall 332, and a second end wall 336. The indentation in the substantially planar member 308 has an opening 324. The side walls 328 and the end walls 332 and 336 form a volume in which ink is stored. The ink receptacle 300 can be configured with a positioning system, such as the positioning system 140 of FIG. 1-3, to move the ink receptacle to collect ink from a printhead and release the ink into a reservoir in the printhead or an ink collecting tray. The side walls 328 are substantially vertical to avoid the ink splashing out of the ink receptacle if the printer is tilted sideways. The angled end walls 332 and 336 release ink at a greater rate than the vertical walls of the embodiment of FIG. 5, enabling the trapezoidal ink receptacle 300 to release more ink over smaller pivot angles than the square ink receptacle 200 described above. In other embodiments, a trapezoidal ink receptacle can have first and second end walls at different angles with respect to the substantially planar member to enable the receptacle to release ink at different rates from the first and second ends.

Figure 7:
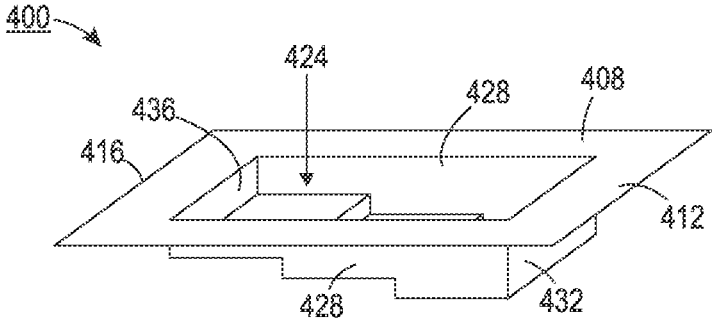
FIG. 7 is a perspective view of a stepped rectangular ink receptacle

FIG. 7 illustrates an ink receptacle 400 having a stepped rectangular cross-section. The ink receptacle 400 has a first end 412, a second end 416, and a substantially planar member 408 in which an indentation is formed by two side walls 428, a first end wall 432, and a second end wall 436. The indentation in the substantially planar member 408 has an opening 424. The side walls 428 and the end walls 432 and 436 form a volume in which ink is stored. The steps in the side walls 428 form a plurality of rectangular prisms having different volumes. The ink receptacle 400 can be configured with a positioning system, such as the positioning system 140 of FIG. 1-3, to move the ink receptacle to collect ink from a printhead and release the ink into a reservoir in the printhead or an ink collecting tray. The side walls 428 are substantially vertical to avoid the ink splashing out of the ink receptacle if the printer is tilted sideways. The vertical end walls 432 and 436 enable reduced flows from the ink receptacle 400 over small pivot angles, enabling more precise control of the release rate of ink in the receptacle 400. The stepped features of the receptacle 400 release the ink at a different rate from the second end 416 than the first end 412.

Figure 8:
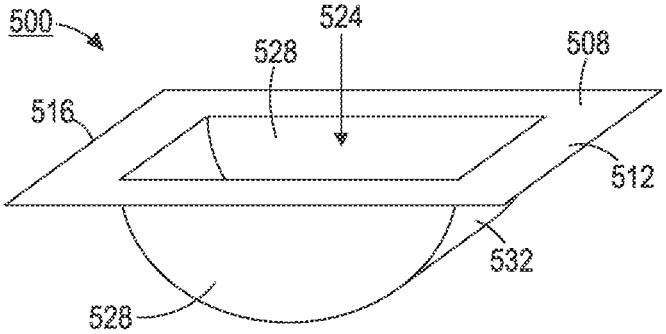
FIG. 8 is a perspective view of a circular ink receptacle.

FIG. 8 illustrates an ink receptacle 500 having a circular cross section. The ink receptacle 500 has a first end 512, a second end 516, and a substantially planar member 508 in which an indentation has been formed with two side walls 528 and a circular wall 532. The indentation in the substantially planar member 508 has an opening 524. The side walls 528 and the circular wall 532 form a volume in which ink is stored. The ink receptacle 500 can be configured with a positioning system, such as the positioning system 140 of FIG. 1-3, to move the ink receptacle to collect ink from a printhead and release the ink into a reservoir in the printhead or an ink collecting tray. The side walls 528 are substantially vertical to avoid the ink splashing out of the ink receptacle if the printer is tilted sideways. The circular wall 532 enables a rapid release of the ink from the ink receptacle 500 at low pivot angles and more precise control of the release rate of ink in the receptacle 500 at higher pivot angles.

Figure 9:
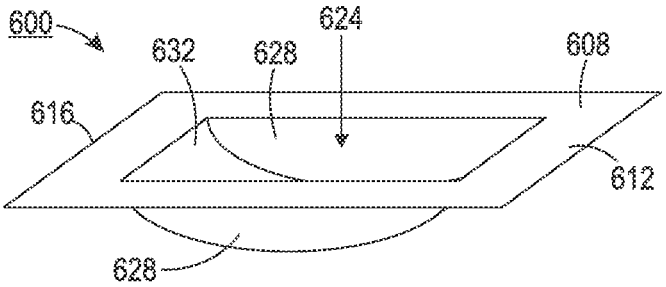
FIG. 9 is a perspective view of an ellipsoidal ink receptacle

FIG. 9 illustrates an ink receptacle 600 having an elliptical cross section. The ink receptacle 600 has a first end 612, a second end 616, and a substantially planar member 608 in which an indentation has been formed with two side walls 628 and an elliptical wall 632. The indentation in the substantially planar member 608 has an opening 624. The side walls 628 and the elliptical wall 632 form a volume in which ink is stored. The ink receptacle 600 can be configured with a positioning system, such as the positioning system 140 of FIG. 1-3, to move the ink receptacle to collect ink from a printhead and release the ink into a reservoir in the printhead or an ink collecting tray. The side walls 628 are substantially vertical to avoid the ink splashing out of the ink receptacle if the printer is tilted sideways. The elliptical wall 632 enables a rapid release of the ink from the ink receptacle 600 at low pivot angles to enable the ink to be emptied from the ink receptacle 600 at low pivot angles.

In other embodiments, the side walls can include a flange at the connection with the substantially planar member to enable the receptacle to retain ink over greater ranges of sideways tilt. In still other embodiments, the ink receptacle can include portions of two or more of the embodiments described in FIG. 4-9, to enable the ink receptacle to have different flow rates from the first end and the second end. For example, in one embodiment, the ink receptacle can include a rectangular cross section at the first end and an elliptical cross section at the second end to enable greater control of release from the first end and complete release over low angles from the second end.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An printing apparatus comprising:

an ink receptacle comprising:

a substantially planar member having a first end and a second end, each of the first end and the second end of the substantially planar member having a cam follower extending from the first end and the second end; and an indentation formed in the substantially planar member to retain a volume of ink, the indentation having a cross-sectional area that enables ink to be released at a rate that varies with an angle at which the substantially planar member pivots; and a positioning system operatively connected to the substantially planar member, the positioning system comprising:

a drive belt operatively connected to the substantially planar member at a position between the first end of the substantially planar member and the second end of the substantially planar member;

an actuator operatively connected to the drive belt, the actuator being configured to rotate the drive belt to move the substantially planar member; and a pair of cam rails, one cam rail receiving the cam follower extending from the first end of the substantially planar member and the other cam rail receiving the cam follower extending from the second end of the substantially planar member, each of the cam rails being configured with a straight portion and a curved portion, the straight portions of the cam rails enable the actuator and the drive belt to move the ink receptacle from a first position where the indentation receives ink from a printhead to a second position where the curved portions of the cam rails enable the actuator and the drive belt to pivot the substantially planar member at a pivot angle that raises the second end of the substantially planar member above the first end of the substantially planar member to enable the indentation to release ink into an ink reservoir at a rate that corresponds to the pivot angle of the substantially planar member.

2. The printing apparatus of claim 1 wherein the cross-sectional area of the indentation is rectangular.

3. The printing apparatus of claim 1 wherein the cross-sectional area of the indentation is trapezoidal.

4. The printing apparatus of claim 1 wherein the cross-sectional area of the indentation is a right triangle.

5. The printing apparatus of claim 1, the indentation comprising:

a plurality of rectangular prisms, each rectangular prism in the plurality of rectangular prisms having a first edge that is vertically aligned with a first edge of the other rectangular prisms in the plurality of rectangular prisms to form a wall that is perpendicular to the substantially planar member, each rectangular prism having a length that is less than a length of an adjacent rectangular prism between the rectangular prism and the substantially planar member.

6. The printing apparatus of claim 1 wherein the cross-sectional area of the indentation is circular.

7. The printing apparatus of claim 1 wherein the cross-sectional area of the indentation is elliptical.

8. The printing apparatus of claim 1, each of the cam rails of the positioning system further comprising:

another curved portion, the other curved portions of the cam rails enable the actuator and the drive belt to pivot the substantially planar member at a pivot angle that raises the first end of the substantially planar member above the second end of the substantially planar member to release ink from the indentation into an ink collection tray.

9. The printing apparatus of claim 1 wherein the ink is a phase change ink.

10. The printing system of claim 9, the ink receptacle further comprising:

a heater configured to melt the phase change ink in the indentation to enable the phase change ink to flow out of the indentation.

11. A printer comprising:

a printhead comprising:

a faceplate having a plurality of inkjet ejectors; and an ink reservoir fluidly connected to the faceplate and configured to supply ink to the plurality of inkjet ejectors;

an ink receptacle comprising:

a substantially planar member having a first end and a second end, each of the first end and the second end of the substantially planar member having a cam follower extending from the first end and the second end; and an indentation formed in the substantially planar member to retain a volume of ink, the indentation having a cross-sectional area that enables ink to be released at a rate that varies with an angle at which the substantially planar member pivots; and a positioning system operatively connected to the substantially planar member, the positioning system further comprising:

a drive belt operatively connected to the substantially planar member at a position between the first end of the substantially planar member and the second end of the substantially planar member;

an actuator operatively connected to the drive belt, the actuator being configured to rotate the drive belt to move the substantially planar member; and a pair of cam rails, one cam rail receiving the cam follower extending from the first end of the substantially planar member and the other cam rail receiving the cam follower extending from the second end of the substantially planar member, each of the cam rails being configured with a straight portion and a curved portion, the straight portions of the cam rails enable the actuator and the drive belt to move the ink receptacle from a first position where the indentation receives ink from the printhead to a second position where the curved portions of the cam rails enable the actuator and the drive belt to pivot the substantially planar member at a pivot angle that raises the second end of the substantially planar member above the first end of the substantially planar member to enable the indentation to release ink into the ink reservoir at a rate that corresponds to the pivot angle of the substantially planar member.

12. The printer of claim 11 wherein the cross-sectional area of the indentation is rectangular.

13. The printer of claim 11 wherein the cross-sectional area of the indentation is trapezoidal.

14. The printer of claim 11 wherein the cross-sectional area of the indentation is a right triangle.

15. The printer of claim 11, the indentation comprising:

a plurality of rectangular prisms, each rectangular prism in the plurality of rectangular prisms having a first edge that is vertically aligned with a first edge of the other rectangular prisms in the plurality of rectangular prisms to form a wall that is perpendicular to the substantially planar member, each rectangular prism having a length that is less than a length of an adjacent rectangular prism between the rectangular prism and the substantially planar member.

16. The printer of claim 11 wherein the cross-sectional area of the indentation is circular.

17. The printer of claim 11 wherein the cross-sectional area of the indentation is elliptical.

18. The printer of claim 11, each of the cam rails of the positioning system further comprising:

another curved portion, the other curved portions of the cam rails enable the actuator and the drive belt to pivot the substantially planar member at a pivot angle that raises the first end of the substantially planar member above the second end of the substantially planar member to release ink from the indentation into an ink collection tray.

19. The printer of claim 11 wherein the ink is a phase change ink.

20. The printer of claim 19, the ink receptacle further comprising:

a heater configured to melt the phase change ink in the indentation to enable the phase change ink to flow out of the indentation.

* * * * *